United States Patent [19]

Huang

[11] Patent Number: 4,688,155

[45] Date of Patent: Aug. 18, 1987

[54] ASSEMBLED LAMPSHADE

[76] Inventor: Mycoh Huang, Fl. 4,84, Min Chih Street, Yungho, Taipei Hsien, Taiwan

[21] Appl. No.: 940,338

[22] Filed: Dec. 11, 1986

[51] Int. Cl.[4] ..... F21V 1/06

[52] U.S. Cl. ..... 362/352; 362/358; 362/360

[58] Field of Search ..... 362/352, 351, 358, 360, 362/356, 357, 417

[56] References Cited

U.S. PATENT DOCUMENTS 1,863,767 6/1932 Shapiro ..... 362/358

2,435,759 2/1948 Spaw ..... 362/358

*Primary Examiner*—E. Rollins Cross

[57] ABSTRACT

The present invention discloses an assembled lampshade which includes two sector shades, a plurality of spiral connectors connected to the edges of the sector shades which are secured to each other in a face-to-face position, and a plurality of supporting members engaged with the sector shades and the spiral connectors to construct a firmly assembled lampshade. During transportation and storage of this lampshade, all of the supporting members can be disassembled and the sector shades with the spiral connectors can be made flat due to their flexibility. Therefore, the space occupied by the lampshade is significantly reduced. When the user desires to use the lampshade it can be readily assembled without any special skills.

2 Claims, 8 Drawing Figures

ASSEMBLED LAMPSHADE

BACKGROUND OF THE INVENTION

The present invention relates to a lampshade, and more particularly to an improved lampshade which can be disassembled for easier transportation and storage, and can be readily re-assembled by the user later.

Conventional lampshades for table lamps have fixed shapes, for example, a frustoconical shape. Their frames are integral and not detachable. They have some inherent drawbacks, for example, since the finished conventional lampshades are bulky and unyielding, they occupy large spaces during transportation or storage resulting in expensive transportation or storage fees. Conventional lampshades also have the tendency of being damaged and deformed during transportation. If the lampshade is damaged, the whole table lamp must be thrown away, even though the lamp itself is still intact. Another example would be a user not liking the color or pattern of a lampshade any more after a long period of use. It is impossible to only substitute a new lampshade for the old one without buying a new table lamp.

An assembled lampshade according to one preferred embodiment of the present invention intends to eliminate the above-described problems.

SUMMARY OF THE INVENTION

One object of the present invention is to provide an assembled lampshade which can be readily disassembled to occupy a smaller space during transportation or storage, so that its transportation fees are significantly reduced. The lampshade can also be easily re-assembled by the user later.

Another object of the present invention is to provide an assembled lampshade which is formed of at least two sector shades and a plurality of supporting frames. The sector shades can be solely substituted to form a new lampshade or a lampshade having a new color, pattern and/or style. This substitution will not affect the intact frames and lamp stand.

In accordance with the present invention, an assembled lampshade comprises two sector shades, each having four arrays of apertures near its top, bottom, first side and second side edges respectively; two top spiral connectors connected to the top edges of the sector shades, respectively, through the arrays of apertures provided near the top edges of the sector shades; two bottom spiral connectors connected to the bottom edges of the sector shades, respectively, through the arrays of apertures provided near the bottom edges of the sector shades; two side spiral connectors, one connecting the first side edge of one of the sector shades and the adjacent second side edge of the other sector shade together, and the other connecting the second side edge of the one sector shade and the adjacent first side edge of the other sector shade together through the corresponding arrays of apertures provided near the side edges of the sector shades; two top supporting frames inserted through the top spiral connectors respectively and detachably engaged with each other at their ends to form a closed ring; two bottom supporting frames inserted through the bottom spiral connectors respectively with their ends opposite to each other; two ribs, each inserted through one of the side spiral connectors, and detachably engaged with one of the top supporting frames at its one end and with one pair of the opposite ends of the bottom supporting frames at its another end so that the bottom supporting frames are detachably engaged with each other through the ribs; and a mounting member adapted to mount the sector shades to a lamp stand, and having two ends detachably engaged with the top spiral connectors respectively.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENT

Figure 4:
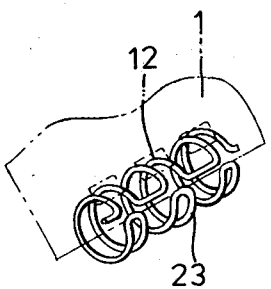
FIG. 4 is a fragmentary enlarged view of a sector shade as shown in FIG. 1, clearly illustrating the spiral connectors according to the preferred embodiment of the present invention.
Figure 1:
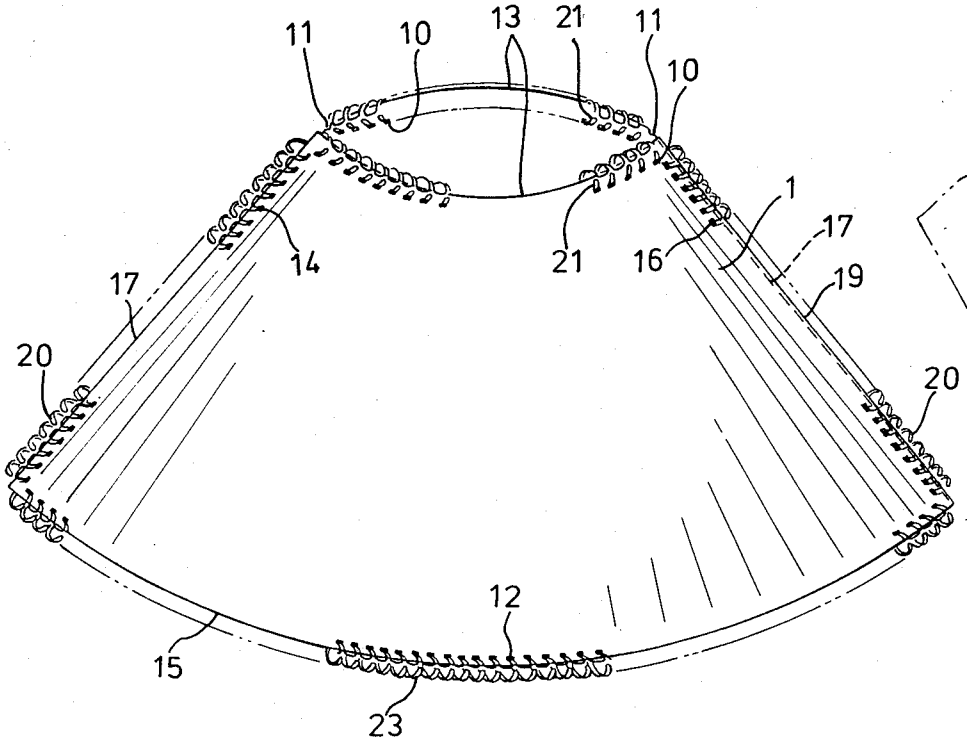
FIG. 1 is a perspective view of two sector shades connected to each other by two side spiral connectors according to one perferred embodiment of the present invention.

Referring now to the drawings, it should be noted that a like member is designated with a like reference number. FIG. 1 shows two sector shades 1 in a slightly expanded position. Each sector shade 1 has four arrays of apertures 10, 12, 14, and 16 provided near its top 13, bottom 15, first side 17 and second side 19 edges respectively. The shades 1 are formed of a flexible material, such as polyvinyl chloride (PVC). Two top spiral connectors 21 are engaged into the two arrays of apertures 10 and thus connected to the top edges 13 of the sector shades 1 respectively. The term "spiral connector" described herein implies a connector which has a structure similar to those being used in spiral notebook, and the like. This enables the sector shades to rotate 360 degrees about the spiral connector. The structure of the spiral connector as shown in FIGS. 1 and 4 illustrates one preferred embodiment of the present invention. Other like structures, however, such as the spiral connector of helical spring type, are also applicable to the present invention.

Figure 3:
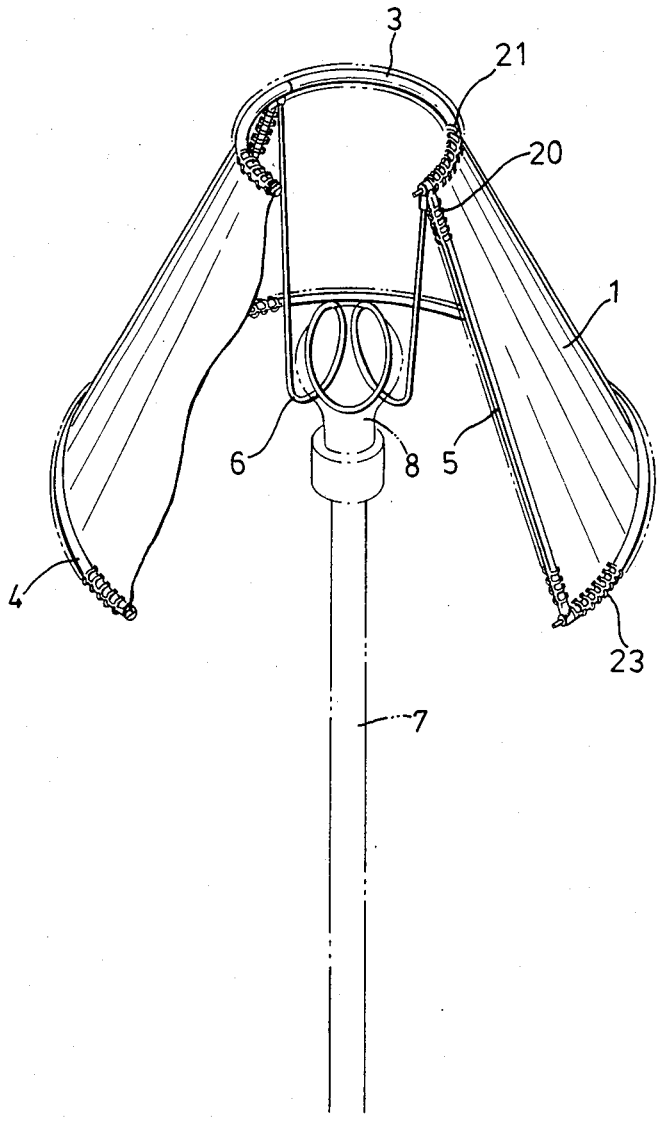
FIG. 3 is a perspective view of an assembled lampshade of the present invention, with part broken away to show the lampshade being mounted on a lamp bulb which is secured to the top of a lamp stand.

Similarly, two bottom spiral connectors 23 are engaged into the two arrays of apertures 12 and thus connected to the bottom edges 15 of the sector shades 1 respectively. Two side spiral connectors 20 connect the sector shades 1 together so that the first side edge 17 of one of the sector shades 1 and the adjacent second side edge 19 of the other sector shade are connected together, and the second side edge 19 of said one sector shade and the adjacent first edge 17 of the other sector shade are connected together. As best seen in FIGS. 1 and 3, the sector shades 1 can be expanded to form a frustoconical shape. When the sector shades 1 is not in use, they can be flattened due to their flexibility.

Figure 2:
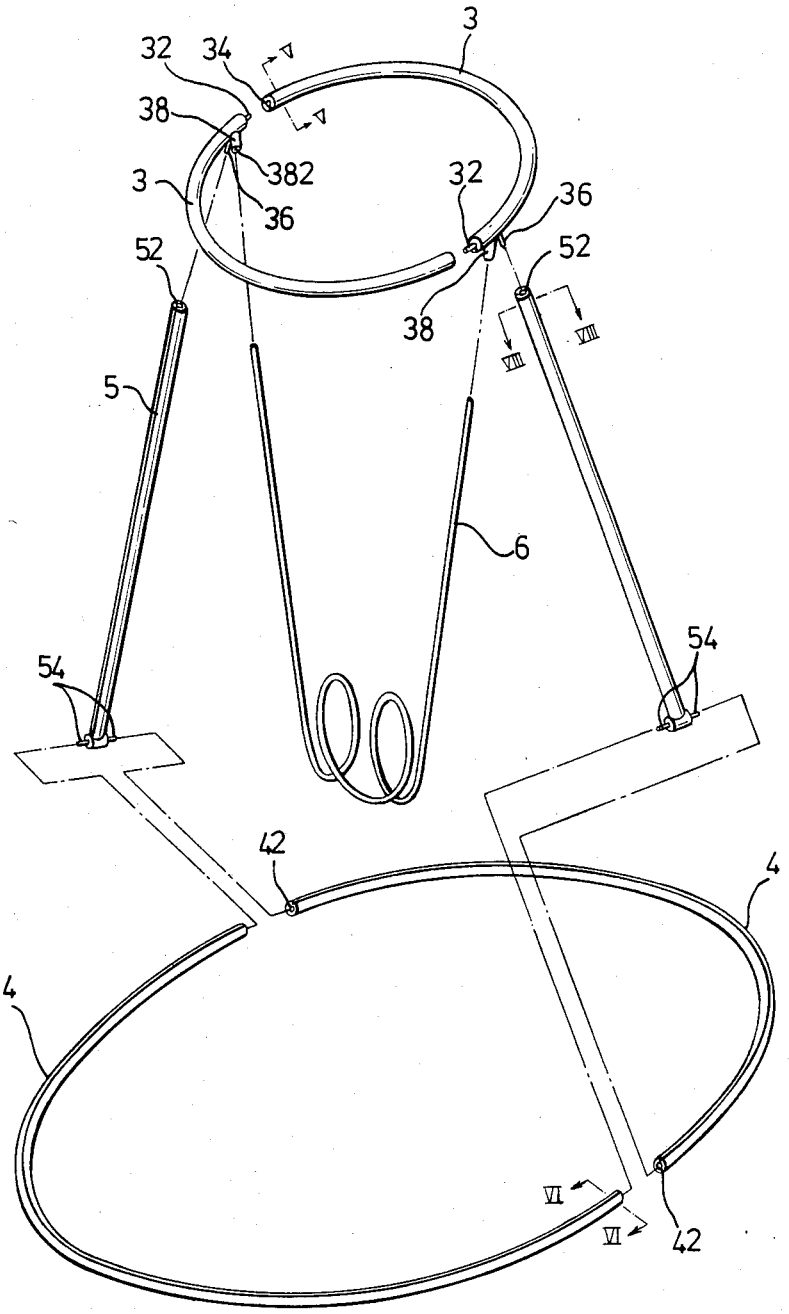
FIG. 2 is an exploded perspective view of the supporting frames for the sector shades of the present invention.

With reference to FIGS. 2 and 3, the supporting structure for the lampshade includes two top supporting frames 3, two bottom supporting frames 4, two ribs 5 and a mounting member 6. Each top supporting frame 3 forms a semicircular shape, and has a projection 32 at its one end and a recess 34 at the other end. When being assembled, two top supporting frames 3 are inserted through the top spiral connectors 21, respectively, and connected at their ends via the engagements between the projections 32 and recesses 34. Thus the top edges 13 of the sector shades 1 are curved by the top supporting frames 3 to form a circular appearance. Each bottom supporting frame 4 also forms a semicircle having a diameter larger than that of the top supporting frame 3, and has a recess 42 at each of its ends. When being assembled, the bottom supporting frames 4 are inserted through the bottom loose-leaf connectors 23, respectively, to curve the bottom edges 15 of the sector shades 1 into a circular shape, whereby the ends of the bottom supporting frames 4 are opposite to each other, as shown in FIG. 2.

Figure 8:
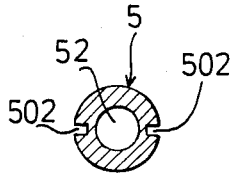
FIG. 8 is an enlarged cross sectional view of the rib taken along a line VIII—VIII in FIG. 2.

Each rib 5 has a recess 52 in its upper end, as best seen in FIG. 8, and two projections 54 near its lower end, which extend in circumferentially opposite directions and are perpendicular to the longitudinal direction of rib 5. Each top supporting frame 3 also has a slim protuberance 36 and a thicker protuberance 38 near one end. The thicker protuberance 38 has a recess 382 in its free end. When being assembled, the ribs 5 are inserted through the side spiral connectors 20 respectively with their recesses 52 in the upper ends engaged to the slim protuberances 36 of the top spiral connectors 21. Then, the recesses 42 in the ends of the bottom spiral connectors 4 are engaged with the projections 54 of the ribs respectively. At that time, a firm lampshade appearance is completed.

Figure 5:
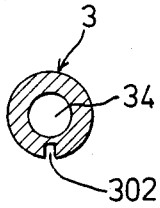
FIG. 5 is an enlarged cross sectional view of a top supporting frame of the present invention, taken along a line V—V in FIG. 2.
Figure 6:
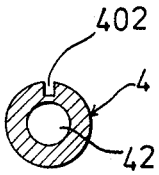
FIG. 6 is an enlarged cross sectional view of a bottom supporting frame of the present invention, taken along a line VI—VI in FIG. 2.
Figure 7:
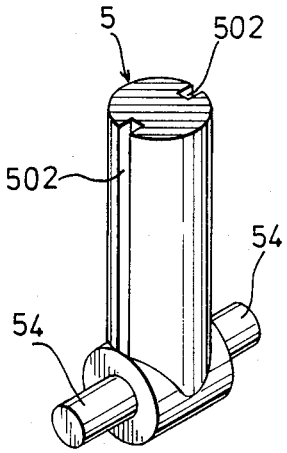
FIG. 7 i a fragmentarily enlarged perspective view of a rib of the present invention.

Each top spiral connector 3 may have a lower groove 302, as shown in FIG. 5, extending along its longitudinal length for engaging with the top edge 13 of the sector shade 1. Each bottom spiral connector 4 has an upper groove 402, as best seen in FIG. 6, extending along its longitudinal length for engaging with the bottom edge 15 of the sector shade 1. Each rib 5 also has two side grooves 502 opposite to each other, as shown in FIGS. 7 and 8, extending along its longitudinal length for engaging with one pair of the adjacent side edges 17, 19 of the sector shades 1. By way of the grooves 302, 402 and 502, the edges of the sector shades are arranged in a fixed position. In order to prevent the sector shades from sliding along the grooves after the lampshade is assembled, the corners of the sector shades all have a cutout 11, as shown in FIG. 4, and the lengths of the grooves are approximately equal to the lengths of the corresponding edges of the sector shades. The grooves 302, 402, and 502 do not extend through the entire lengths of the top and bottom supporting frames 3, 4 or the ribs 5.

It should be understood that in order to facilitate the assembly of the lampshade of the present invention, the supporting frames 3, 4 and the ribs 5 may be formed of a material having a slight flexibility.

The mounting member 6, in FIG. 3, has two upper ends inserted into the recesses 382 of the thicker protuberances 38, and has a mounting zone at its lower portion for mounting on a lamp bulb 8 which is secured to the top of a lamp stand 7. It should be noted that other types of mounting members can also be used. This is obvious to those who are ordinarily skilled in the art.

During transportation and storage of the lampshade of the present invention, all of the supporting frames, ribs and mounting member are disassembled, and the sector shades are flat due to their flexibility. The space occupied by the lampshade is significantly reduced, resulting in a decrease in transportation costs. When one desires to use the lampshade, he can readily assemble it without any special skills.

Although the preferred embodiment of the present invention utilizes two sector shades to form a lampshade, it should be obvious to the skilled person in the art that more than two sector shades are also applicable to the present invention.

While the invention has been described in connection with what is presently considered to be the most practical and preferred embodiment, it is to be understood that the invention is not to be limited to the disclosed embodiment but, on the contrary, is intended to cover various modifications and equivalent arrangements included within the spirit and scope of the appended claims which scope is to be accorded the broadest interpretation so as to encompass all such modification and equivalent structure.

What is claimed is:

1. An assembled lampshade comprising:

two sector shades, each having four arrays of apertures near its top, bottom, first side and second side edges respectively;

two top spiral connectors connected to the top edges of said sector shades, respectively, through said arrays of apertures provided near the top edges of said sector shades;

two bottom spiral connectors connected to the bottom edges of said sector shades, respectively, through said arrays of apertures provided near the bottom edges of said sector shades;

two side spiral connectors, one connecting the first side edge of one of said sector shades and the adjacent second side edge of the other sector shade together, and the other connecting the second side edge of said one sector shade and the adjacent first side edge of said other sector shade together through said corresponding arrays of apertures provided near the side edges of said sector shades;

two top supporting frames inserted through said top spiral connectors respectively and detachably engaged with each other at their ends to form a closed ring;

two bottom supporting frames inserted through said bottom spiral connectors respectively with their ends opposite to each other;

two ribs, each inserted through one of said side spiral connectors, and detachably engaged with one of said top supporting frames at its one end and with one pair of the opposite ends of said bottom supporting frames at its another end so that said bottom supporting frames are detachably engaged with each other through said ribs; and a mounting member adapted to mount said sector shades to a lamp stand, and having two ends detachably engaged with said top spiral connectors respectively.

2. An assembled lampshade as claimed in claim 1, wherein each of said top spiral connectors has a lower groove along its length for engaging witht he top edge of one of said sector shades; each of said bottom spiral connectors has an upper groove along its length for engaging with the bottom edge of one of said sector shades; and each of said side spiral connectors has two side grooves along its length for engaging with one pair of the adjacent side edges of said sector shades.

* * * * *